US005140709A

United States Patent [19]

Cohn et al.

[11] Patent Number: 5,140,709

[45] Date of Patent: Aug. 25, 1992

[54] GOLF GLOVE

[75] Inventors: Lloyd D. Cohn, Margate; B. Louis Blumberg, Ocean City, both of N.J.

[73] Assignee: Pocketec, Inc., Ventnor, N.J.

[21] Appl. No.: 468,463

[22] Filed: Jan. 22, 1990

[51] Int. Cl.[5] ..... A41D 19/00

[52] U.S. Cl. ..... 2/163; 2/161 A

[58] Field of Search ..... 2/163, 161 A, 159, 161 R

[56] References Cited

U.S. PATENT DOCUMENTS

| | | | |
|---|---|---|---|
| 594,499 | 11/1897 | Suit | 2/161 R |
| 2,092,318 | 9/1937 | Lindfelt | 2/161 A |
| 2,725,570 | 12/1955 | Penna | 2/163 |
| 2,827,635 | 3/1958 | Rasmus | 2/21 |
| 2,836,828 | 6/1958 | Henrikson | 2/158 |
| 3,952,333 | 4/1976 | Fujita | 2/161 A |
| 4,345,335 | 8/1982 | Shih-Li | 2/161 A |
| 4,907,297 | 3/1990 | Gallucci | 2/163 |

FOREIGN PATENT DOCUMENTS

| | | | |
|---|---|---|---|
| 502658 | 3/1939 | United Kingdom | 2/163 |

*Primary Examiner*—Werner H. Schroeder
*Assistant Examiner*—Sara M. Current
*Attorney, Agent, or Firm*—Blum Kaplan

[57] ABSTRACT

A full hand covering golf glove for use on a hand having fingernails extending beyond the fingertip includes a palm covering having an opening at one end. A plurality of finger coverings communicate with the palm covering at a first end of the finger covering and extend to a distal end. The distal end extends beyond the portion of the finger to which the fingernail is secured and is formed with an opening at the distal end which is dimensioned and disposed to allow a portion of the fingernail extending beyond a fingertip to extend therethrough.

19 Claims, 1 Drawing Sheet

GOLF GLOVE

BACKGROUND OF THE INVENTION

The invention is directed to a golf glove, and in particular, to a full golf glove to be worn by people having long fingernails.

Golf gloves are well known in the art for providing a secure sensitive grip between the hand and golf club while protecting the hand. These golf gloves are generally available in two types; a half glove or a full glove. The full glove includes a palm covering and four sealed finger covering extending therefrom and communicating with the palm covering to allow the fingers and the hand to extend within the glove. A thumb covering is also integrally formed at the palm covering and communicates therewith to accommodate the thumb of the user and provide protection therefore.

These conventional golf gloves have been satisfactory. However, they do not readily accommodate the hand of a golfer having long fingernails such as a woman. Due to the fact that many women's fingernails extend beyond the fingertips, the distal tip of the finger and the crotch between the fingers in a conventional glove do not come flush with the glove. The slack formed at both regions causes the glove to bunch up and collect at the finger tips. This results in less sensitivity for the golfer with regard to the golf club. Additionally, the player's extended fingernail shifts the complete body of the glove approximately ½ inch upward leaving spaces and folds around the perimeter of the palm, i.e. in the crotch between each finger. This lack of contact between glove and hand compromises the anatomical integrity of the glove. As the player's hand grips the glove, her three knuckled joints take contracted position. The nail slots allow the glove to shift into the proper position taking full advantage of the inherent stress points in any basic glove design. Maximum freedom of movement and a more natural embrace of the club shaft is achieved. Additionally, the long fingernails jutting against the top of the glove provide a stress point increasing the likelihood of tears in the glove or breakage of the fingernails.

A conventional glove which prevents slack in the fingers is also known in the art. This glove extends to the first knuckle of the user allowing the remaining two thirds of the fingers to extend through an opening at the top of the glove. This half glove prevents the fingernail from extending into the top of the finger. However, this glove suffers from the disadvantage that it does not provide protection for the finger extending between the second knuckle and distal end of the finger nor does it provide an improved grip provided by the glove leather acting on the club shaft.

Accordingly, it is desirable to provide a golf glove which can be worn comfortably by a golfer having long fingernails and overcomes the shortcomings of the prior art by providing a contour fit to the fingertips while reducing the stress on the glove for golfers having long fingernails.

SUMMARY OF THE INVENTION

Generally speaking, in accordance with the invention, a golf glove adapted to receive a hand having long fingernails is provided. The golf glove includes a palm covering having an opening at the bottom thereof for receiving the hand of the golfer. Four finger coverings communicate with the palm covering and extended therefrom at different lengths corresponding to each finger of the golfer. A thumb covering also communicates with the palm covering and receives the thumb of the golfer's hand. Each of the fingers coverings and thumb covering extend from the base of the finger or thumb to the portion of the golfer's finger where the nail extends beyond the finger. An opening dimensioned to allow the fingernail to pass through is provided at a distal end of each finger covering so that the glove is anchored between the wrist of the user and the fingertips of the golfer's hand providing a contour fit between the glove and the golfer's hand.

Accordingly, it is an object of the present invention to provide an improved golf glove.

A further object of the invention is provide a full golf glove to accommodate a golfer having long fingernails which does not ride up or bunch on the hands of the golfer.

Another object of the present invention is to provide a full golf glove for use by a person having long fingernails which increases sensitivity and contour fit.

Yet another object of the invention is to provide a longer lived golf glove.

A further object of the invention is to provide a golf glove which prevents breaking of the glove, and/or breaking of fingernails while providing protection for the entire user's fingers.

Still another object of the invention is to provide a completely contoured glove with reduced slack or play significantly improving overall grip.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Figure 1:
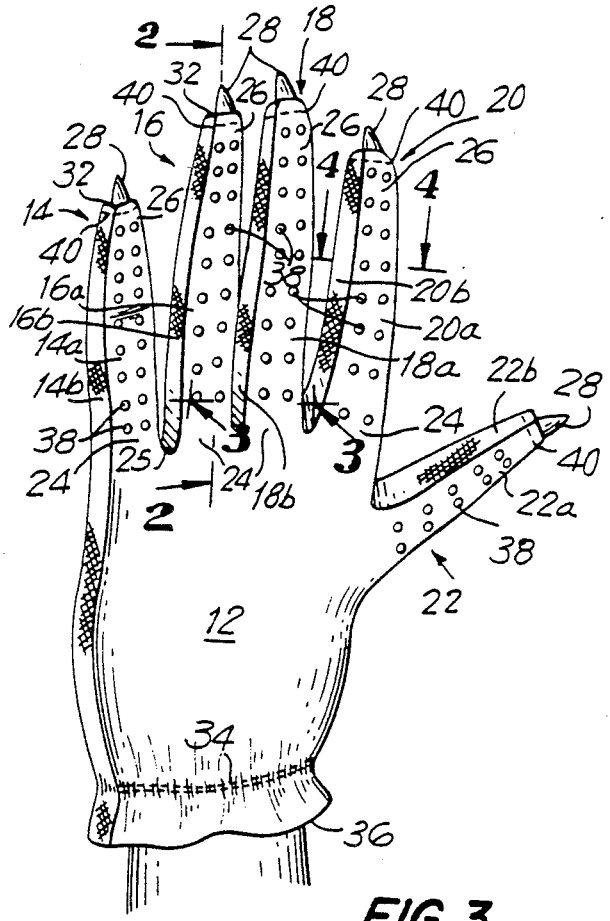
FIG. 1 is a perspective view of a glove constructed in accordance with the invention as worn on the hand of a user.

Reference is now made to FIGS. 1–4 wherein a golf glove generally indicated as 10, constructed in accordance with the invention is provided. Glove 10 includes a palm covering 12 for covering and protecting the palm of the user. Palm covering 12 is provided with an opening 36 for receiving the hand of the user. Opening 36 extends below the wrist of the user's hand. Each of a user's finger is enclosed in a respective pinky covering 14, ring finger covering 16, middle finger covering 18, index finger covering 20 and thumb covering 22, respectively. Each finger covering, 14–22 communicates with palm covering 12 through an opening 45 to allow the hand of the user to slide through opening 36, palm covering 12 and into respective finger coverings 14–22 in a single continuous motion.

Figure 2:
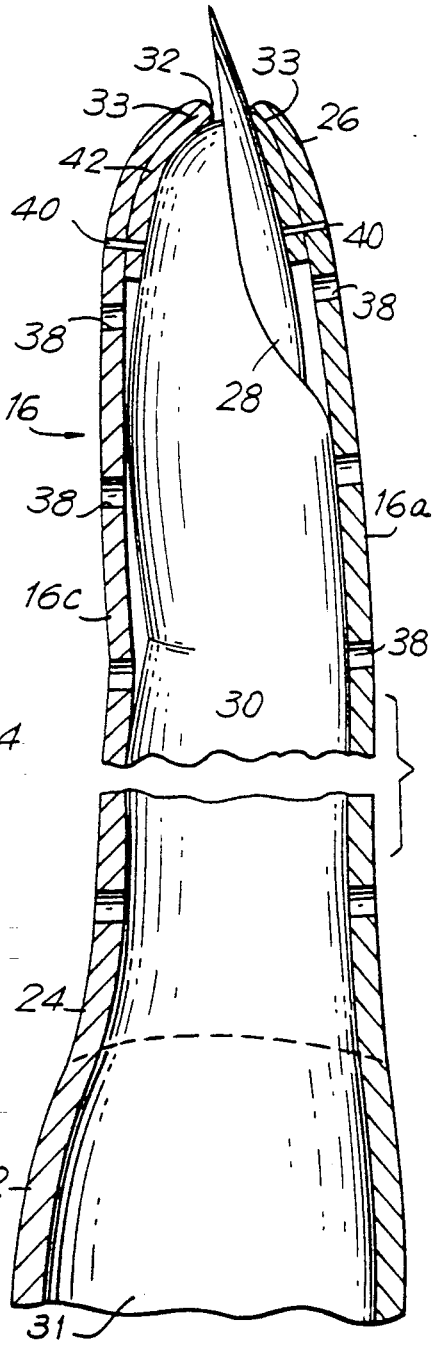
FIG. 2 is a sectional view taken along line 2—2 of FIG. 1.

Each finger covering has a respective proximal end 24 which is adjacent palm covering 12 to communicate therewith and a distal end 26. The construction of each respective finger covering 14–22 is similar varying only in degree of length to accommodate the respective finger. Accordingly, reference is made only to ring finger covering 16 (FIG. 2) and index finger cover 20 (FIG. 3) for simplicity of description. Ring finger covering 16 extends beyond the portion of finger 30 to which fingernail 28 is attached at the distal end of the wearer's finger 30. Distal end 26 of ring finger covering 16 is formed with an opening 32 therein. Opening 32 is dimensioned so that only the portion of fingernail 28 extending beyond finger 30 extends through opening 32. Opening 32 is substantially coaxial with ring finger covering 16 (FIGS. 1, 2). In an exemplary embodiment, opening 32 only allows the finger nail to pass through. However, opening 32 may be slightly larger so that a small portion of the fingertip may extend, as long as distal end 26 is anchored to the distal end of finger 30 above the portion where nail 28 is affixed to finger 30.

Palm covering 12 is anchored to a the hand of the user through the use an elastic band 34 or the like provided therein adjacent opening 36 within palm region 12. Accordingly, glove 10 is anchored adjacent the wrist by elastic band 34 at one end and is anchored by the tension interaction between finger 30 attempting to extend through opening 32 at its other end. These two anchoring devices working in opposite directions act to maintain glove 10 taught about the hand of the user causing finger coverings 14–22 to contour to the fingers. This contour action prevents bagging and bunching while maintaining a sure grip and sensitive feel between the hand and the club being gripped.

Figure 3:
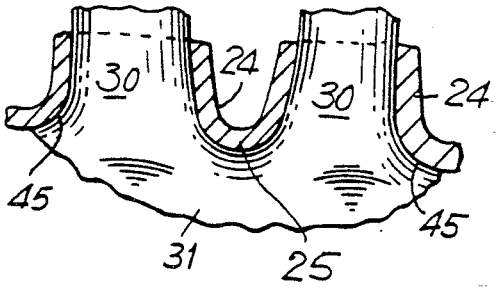
FIG. 3 is a sectional view taken along lines 3—3 of FIG. 1.
Figure 4:
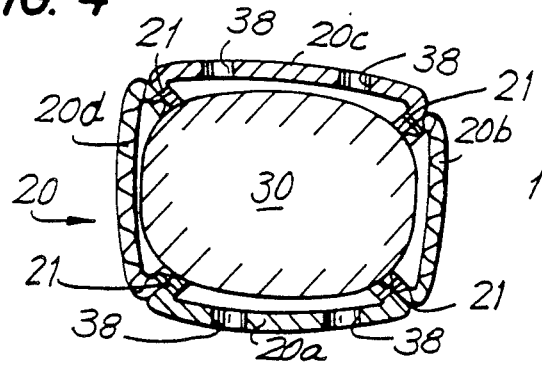
FIG. 4 is a sectional view taken along line 4—4 of FIG.

As specifically seen in FIG. 3, by anchoring glove 10 between the fingertip and the wrist of the user, the crotch 25 formed in glove 10 between adjacent proximal ends 24 remains flush with fingers 30 and palm 31. This maintains the contact between glove and hand allowing the glove to shift into the proper position within the glove taking full advantage of the inherent stress points in the glove design. This allows maximum freedom of movement while providing a more natural contact with the club shaft when compared to that provided by conventional gloves.

The diameter of proximal end 24 is larger than the diameter of distal end 26 providing a tapered fit to increase the contour fit about the fingers further preventing bagging and increasing sensitivity. In an exemplary embodiment opening 32 has a diameter between 1/16 of an inch and ¼ of an inch.

A plurality of holes 38 are provided within each finger covering 14–22 to allow air to pass within and without of the glove during use providing ventilation to the hand. Ventilation holes 38 extend from proximal end 24 to distal end 26 along each finger covering 14–22. As seen more particularly, in FIG. 3 in an exemplary embodiment each finger covering 14–22 is made of four distinct panels 20*a*, 20*b*, 20*c* and 20*d*. Each panel is situated adjacent another panel and secured to two other panels by a thread 21 or the like to form a substantially square index finger covering 20. Additionally, open end 32 may be formed at distal end 26 by folding distal end 26 of respective panels 20*a*, 20*b*, 20*c* and 20*d* within opening 32 about a fold line 33 and securing each panel to itself below opening 32 by a thread 40 or the like to form an inner lining 42 which reduces wear and tear on distal end 26 of finger coverings 14–22.

In this embodiment of glove 10, each finger covering 14–22 22 is formed of four adjacent panels secured together. However, it is also possible to construct each finger covering 14–22 as a unitary piece of material integrally formed with palm covering 12 or two or more panels. Additionally, in the present embodiment of glove 10 an elastic band 34 is utilized to secure glove 10 below the wrist of the user. However, it is also contemplated that other conventional anchoring means such as a velcro secured opening or a slot extending parallel to the arm of the user which is closed with a button be used for anchoring glove 10 about the wrist. The glove has been defined in terms of a golf glove by way of example only. The glove is also applicable where glove sensitivity is desired while preventing bagging and bunching; accordingly other uses for such a glove include driving gloves, batting gloves or the like are contemplated.

By providing a golf glove having palm covering connecting a glove opening to a finger covering for each respective finger in which each finger covering has an opening at its distal end dimensioned for allowing only the fingernails of a user to pass therethrough, a golf glove which prevents bunching and bagging and thereby improving a golf glove touch sensitivity while preventing breaking of the glove and the fingernails while protecting the hand is provided. By forming the distal end opening with a fold line portion an inner lining is provided which reduces wear and tear on the golf glove increasing the life of the golf glove relative to the prior art golf glove.

It will thus be seen that the objects set forth above, among those made apparent from the preceding description, are efficiently attained and, since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A full hand covering glove for use by a wearer having long fingernails extending beyond the end of the wearer's fingertips, comprising:

a palm portion for covering the palm of the wearer's hand formed with a first opening for receiving the fingers and hand; and a plurality of finger coverings communicating with the palm portion at a first end of the palm portion opposite the first opening, each finger covering having a nail opening at a distal end thereof, the nail opening being substantially coaxial with the finger covering and dimensioned to allow at least a portion of the fingernail to extend through the nail opening and exposing a first portion of the associated fingertip with the finger covering being anchored about a second portion of the associated fingertip at the distal tip of the finger above a portion of the associated fingertip where the fingernail is affixed to the associated finger, whereby the wearer's hand is substantially covered by the glove to provide protection to the hand and fingers, yet provide sufficient nail opening in the fingers to allow the fingernails to be exposed.

2. The glove of claim 1, further comprising securing means located about the first opening for selectively securing the glove about a hand.

3. The glove of claim 2, wherein the securing means includes an elastic member.

4. The glove of claim 2, wherein the securing means is a snap.

5. The glove of claim 1, wherein the nail opening is formed by folding the distal end of the finger covering upon itself about a fold line to form a hem dimensioned to provide a snug fit about the fingertips protruding through the nail openings.

6. The glove of claim 1, wherein each finger covering is formed of a plurality of panels, the panels being secured to an adjacent panel to form a substantially rectangular shape.

7. The glove of claim 1, further comprising venting means for allowing air flow through each finger covering.

8. The glove of claim 7, wherein the venting means includes a plurality of holes formed in each finger covering extending from the proximal end to the distal end of the finger covering.

9. The glove of claim 1, including a thumb covering.

10. The glove of claim 1, including at least four finger coverings.

11. The glove of claim 10, including a thumb covering.

12. The glove of claim 1, wherein distal end of the finger covering substantially covers the fingertip.

13. A full hand covering glove for use by a wearer having long fingernails extending beyond the end of the wearer's fingertips, comprising:

a palm portion for covering the palm of the wearer's hand formed with a first opening for receiving the fingers tip therein;

securing means located about the first opening for selectively securing the glove about a hand;

a plurality of finger coverings, communicating with the palm portion at the first end of the palm portion opposite the first opening, each finger covering having a nail opening therein at a distal end thereof, the nail opening being substantially coaxial with the finger covering and dimensioned to allow a portion of a fingernail extending beyond a fingertip to extend therethrough and exposing a first portion of the associated fingertip, the finger covering being anchored about a second portion of the associated fingertip above a portion of the associated fingertip where the fingernail is affixed to the associated finger, the nail opening being formed by folding the distal end of the finger covering upon itself about a fold line to form a hem dimensioned to provide a snug fit about the second portion of the fingertip; and venting means for allowing air flow through each finger covering.

14. The glove of claim 13, wherein said securing means includes an elastic band.

15. The glove of claim 14, wherein the venting means includes a plurality of holes formed in each finger covering extending from the proximal end to the distal end of the finger covering.

16. The glove of claim 15, wherein distal end of the finger covering substantially covers the fingertip.

17. The glove of claim 16, wherein each finger covering is formed of at least two panels, the panels being secured together.

18. The glove of claim 17, including a thumb covering.

19. The glove of claim 18, including at least four finger coverings.

* * * * *